US006360375B1

(12) United States Patent
Hart

(10) Patent No.: US 6,360,375 B1
(45) **Date of Patent: *Mar. 26, 2002**

(54) BUTTOCKS SUPPORT DEVICE

(76) Inventor: Karin Hart, 18462 Via Bravo, Villa Bravo, CA (US) 99268

( * ) Notice: Subject to any disclaimer, the term of this patent is extended or adjusted under 35 U.S.C. 154(b) by 0 days.

This patent is subject to a terminal disclaimer.

(21) Appl. No.: 09/566,072

(22) Filed: May 8, 2000

Related U.S. Application Data

(63) Continuation-in-part of application No. 09/187,011, filed on Nov. 4, 1998, now Pat. No. 6,058,514.

(51) Int. Cl.[7] ..... A41B 9/00

(52) U.S. Cl. ..... 2/406; 2/408; 2/67; 450/101; 450/155

(58) Field of Search ..... 450/100, 101, 450/106, 107, 129–134, 136, 137, 148, 155; 2/406, 408, 400, 311–312, 67, 69

(56) References Cited

U.S. PATENT DOCUMENTS 1,642,279 A * 9/1927 Volker, Jr. ..... 450/155
2,088,800 A * 8/1937 Malouf ..... 2/406
3,094,990 A * 6/1963 Neuson ..... 2/406
3,524,449 A * 8/1970 Peters ..... 450/155
4,121,305 A * 10/1978 Kolker ..... 2/406
4,501,024 A * 2/1985 Russo ..... 2/67
4,698,847 A * 10/1987 Yoshihara ..... 2/69
4,932,079 A * 6/1990 Bridgewater ..... 2/313
5,485,636 A * 1/1996 Yandell ..... 2/406
5,876,395 A * 3/1999 Hart et al. ..... 604/393
5,902,170 A * 5/1999 Ganz ..... 2/406 X
6,058,514 A * 5/2000 Hart ..... 2/406

* cited by examiner

*Primary Examiner*—Gloria M. Hale
(74) *Attorney, Agent, or Firm*—Richard B. Klar

(57) ABSTRACT

A Buttocks Support Device is disclosed. Also disclosed is a support device that comprises an abdominal element and a pair of thigh support elements each of which can be, but is not limited to be, formed as a ring shaped element. Each thigh support element has a buttock section and a midriff or abdominal section, the buttock section being configured to lift and restrain the wearer's buttock. The preferred device includes a sleeve thereover for permitting the "rings" to be tightened without pulling on the wearer's skin. It is a further aspect that the device anchor about the wearer's midriff from below the chest to the widest part of the hips or at either the waist or the hips, depending upon the wishes of the wearer. Still further, the thigh support element include adjustment means for adjusting the length of the thigh rings. Furthermore, the preferred abdominal element includes means for attaching and detaching the device from around the wearer's waist as well as adjustment means. Alternatively, the device may be custom fitted to the size of the wearer.

22 Claims, 8 Drawing Sheets

BUTTOCKS SUPPORT DEVICE

RELATED APPLICATIONS

The present application is a continuation in part application of U.S. patent application Ser. No. 09/187,011 filed on Nov. 4, 1998, now U.S. Pat. No. 6,058,514, patented on May 9, 2000, and for which priority is claimed under 35 U.S.C. 120.

Reference is made to co-pending design patent application U.S. Ser. No. 29/104,278 filed on May 1, 1999.

BACKGROUND OF THE INVENTION

1. Field of the Invention

This invention relates generally to support garments and, more specifically, to a Buttocks Support Device.

2. Description of Related Art

In today's society both women and men have become increasingly more concerned with their appearance. A variety of approaches are being taken to improve one's physical appearance, including cosmetic surgery, exercise, dieting, as well as enhancements to the body shape acquired through the wearing of a variety of undergarments. The problem with these previous below-the-waist undergarments, is that none lifts, supports and shapes a person's buttocks similar to the underwire bra that is a fairly common undergarment for women today. While there have been a variety of devices that add padding or some other shape to the buttock, none actually lift it, while also giving it a desirable shape.

Furthermore, as mentioned earlier, after cosmetic surgery involving liposuction or other procedure to the buttock area it is a standard procedure for the patient to be required to wear some sort of garment, such as shorts of a girdle or other device. These devices press the skin into the desired position while the skin re-attaches to the structure beneath it. The problem with wearing these stretch pants and girdles is that they are extremely uncomfortable. In the days following these liposuction procedures the skin is extremely tender and therefore the last thing that the patient wants is to have something pressing against the surfaces that were just bruised during the surgery. What's needed is a less intrusive alternative or supplemental means for holding the skin into the desired position. The present invention is designed to lift, hold in place and provide a desirable shape to the buttocks in the same way that the brassiere is designed to accomplish this goal for breasts.

SUMMARY OF THE INVENTION

In light of the aforementioned problems associated with the prior devices, it is an object of the present invention to provide a Buttocks Support Device. The preferred support device will comprise an abdominal element and a pair of support elements. Each thigh support element may be comprised of one or two pieces depending upon the means of adjustment.

Each thigh support element will preferably comprise a buttock section and an abdominal section, the buttock section being configured to lift and uphold the wearer's buttock.

It is an object of the invention that the thigh support elements include adjustment means for adjusting the length of the thigh support elements and that the abdominal element include adjustment means for adjusting its length in order to ensure a custom fit for each individual wearer. This is an essential feature of the invention.

It is still a further object of the invention to provide each embodiment of the invention in which the thigh support elements are attached at the ends of the lower abdominal section and at the ends of the buttocks' section to the two points respectively of the abdominal element. There could be an alternative location for each of the two points of attachment to account for variances in individual bodies.

It is a further object of the invention that the invention anchor at either the waist or the hips or anywhere in between the waist and the hips, depending upon the wishes of the wearer, for the purpose of supporting the downward pull of the thigh support elements.

It is a further object that the device include a sleeve thereover for permitting thigh support elements to be tightened without pulling on the wearer's skin. It is a still further object that the device anchor at either the waist or the hips, depending upon the wishes of the wearer. It is a still further object that the thigh support elements include adjustment means for adjusting the length of the thigh support elements. Furthermore, the preferred abdominal element will include means for attaching and detaching the device from around the wearer's waist.

It is yet another object of the invention that the invention include sleeves encasing the thigh support elements which permit the thigh support elements to move independently of the sleeves to permit individual custom adjustment.

Further the fabric can also be securely attached to the abdominal element and cover as much of the actual buttocks and abdominal area as each individual wearer desires, thereby creating articles of clothing with the invention.

Furthermore, the preferred abdominal element will include means for attaching and detaching the invention at any point around the wearer's waist.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out her invention. Various modifications, however, will remain readily apparent to those skilled in the art, since the generic principles of the present invention have been defined herein specifically to provide a Buttocks Support Device.

Figure 1:
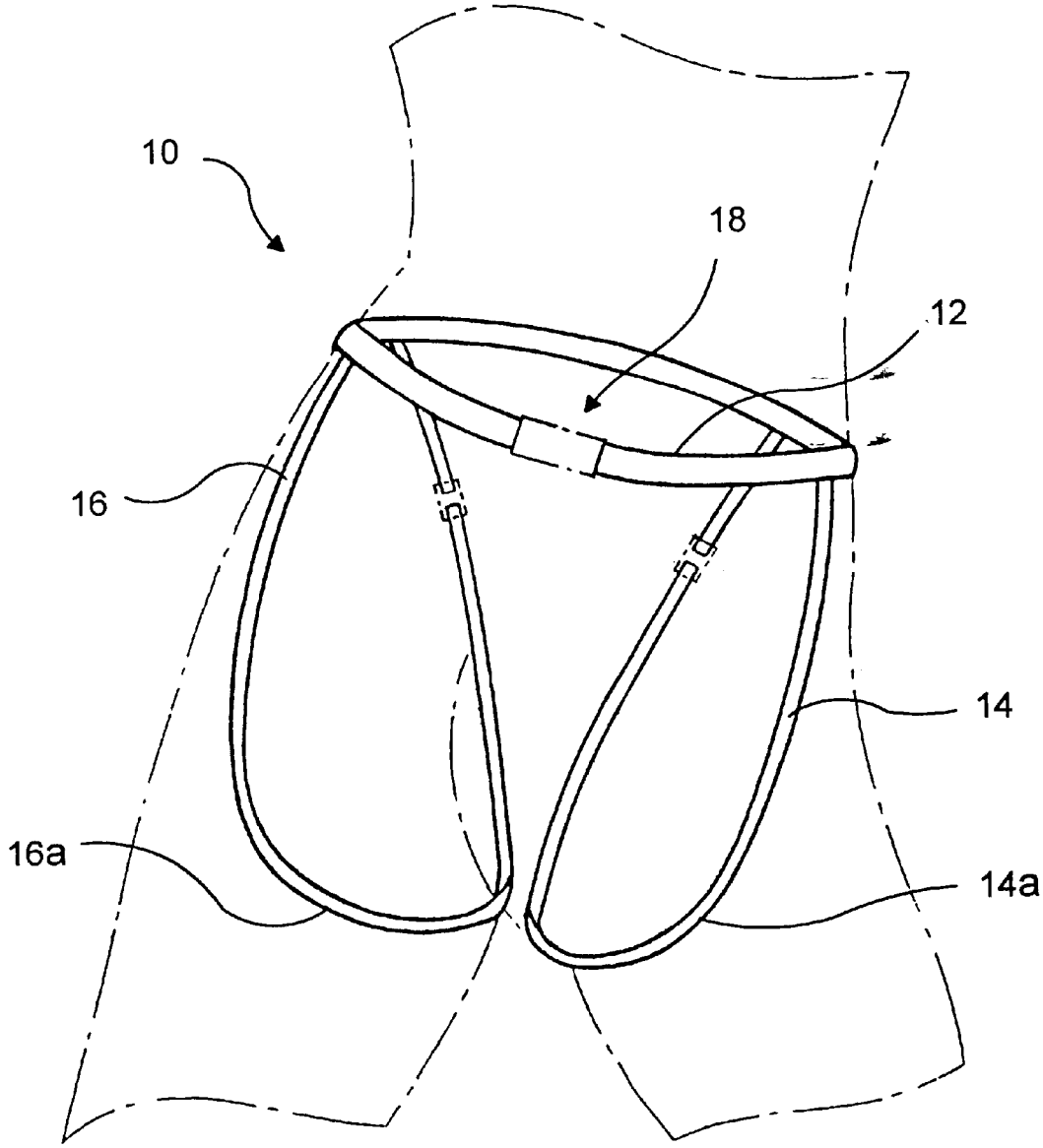
FIG. 1 is a front view of the preferred buttocks support of the present invention as it might be worn by an individual.

The present invention can best be understood by initial consideration of FIG. 1. FIG. 1 is a back view of a preferred buttocks support 10, of the present invention as it might be worn by an individual. As seen from the back, the device comprises abdominal element 12, formed as a ring but not limited to any particular shape, and a pair of thigh support elements formed as rings but not limited to any particular shape 14 and 16, respectively.

Each thigh support element comprises a buttock section 14a and 16a, respectively. As can also be seen, each thigh support element 14 and 16 encircle the buttock at the lower and outer edges thereof to lift and shape the buttock, while still leaving the center (cleft) area open in those embodiments in which fabric is not attached is not attached to cover the buttocks and/or the abdomen, which are other possible embodiments of the present invention. Furthermore, the abdominal element 12 would also include attachment means 18, to permit the donning and removing of the buttocks support 10 and adjustment means for sizing purposes. It should be understood that while the abdominal element 12 is shown at the wearer's hip level, it might be re-positioned anyplace along the abdomen, including but not limited to the wearer's waist, as desired. Thus, although the abdominal element 12 is shown here as being worn on the waist or abdomen of the user, it is understood that it can be worn any where on a user's midriff from just below the chest area to the widest part of a user's hips based upon a user's sizing, comfort and preference.

In addition the thickness of the abdominal element 12 can vary to as thick as 5 inches thick.

Also, the support 10 could also include fabric which is attached to the support 10 to cover the buttocks and/or the lower abdomen (not shown) over a portion or substantially all of the support 10. The sleeve (FIG. 6) should permit the user to tighten or loosen the support 10 without pulling on the skin. The fabric (FIG. 6) is preferably constructed from cloth or other covering. For example, a thong—like attachment can attached to the back of the waist band or abdominal element 12 and fabric material can also be attached to the front abdominal area of the front of the abdominal element to form a thong—like bikini bottom. Other clothing article cab also be made with attachment of fabric to the support 10 or by incorporating the support into articles of clothing.

The abdominal support element 12 and the thigh support elements 14 and 16 can be covered with material, e.g. sleeves to prevent these support elements which can be formed as but not limited to straps from chafing the skin of the user by providing a soft protective sleeve material. The sleeves for these support elements 12, 14 and 16 preferable have openings to permit the user access to the adjustment means and in the case of the abdominal element 12, the attachment means. Thus the sleeves are free flowing in that they permit the adjustment means on support elements 12, 14 and 216 to be accessible and workable and the placement of the fabric of the sleeves over the support 10 does not pull the support 10 out of place. While adjustment means are provided for the abdominal elements 12 and thigh support elements 14 and 16 alternatively the buttocks support 10 can be custom designed and custom fitted for an individual wearer's size so that no adjustment means are required. Further the adjustment means on the abdominal element 12 although shown as being located on the front of element 12 can be located anywhere along element 12 including the back of element 12 (the same is true for the attachment means). Similarly the location of the adjustment means for elements 14 and 16 can be located anywhere along the elements 14 and 16 as desired.

Figure 2A:
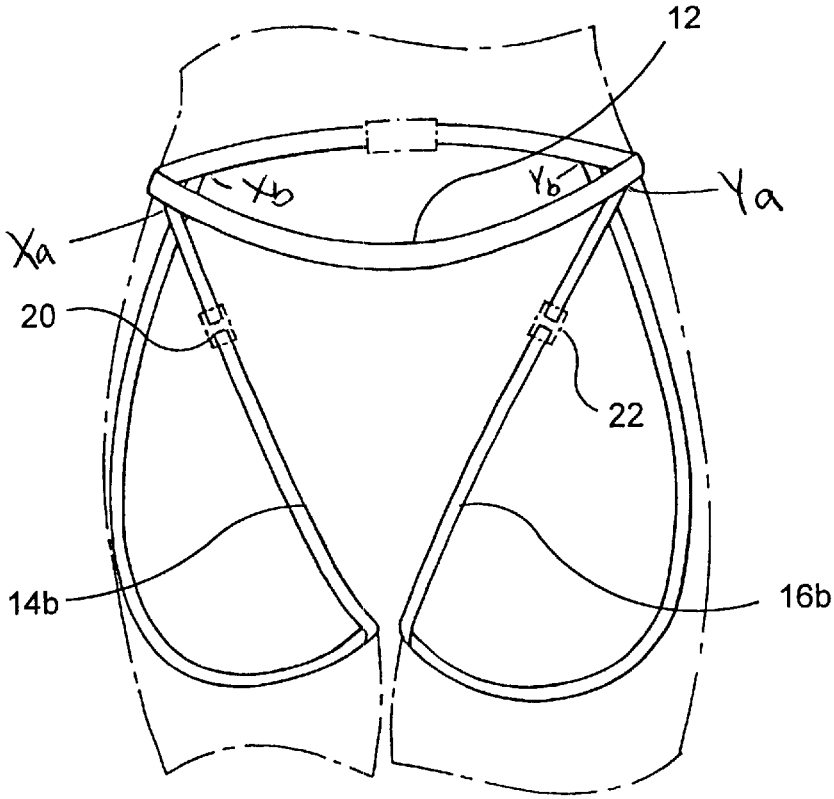
FIGS. 2A and 2B are back and side views, respectively, of the buttocks support of FIG. 1 as worn by an individual.
Figure 2B:
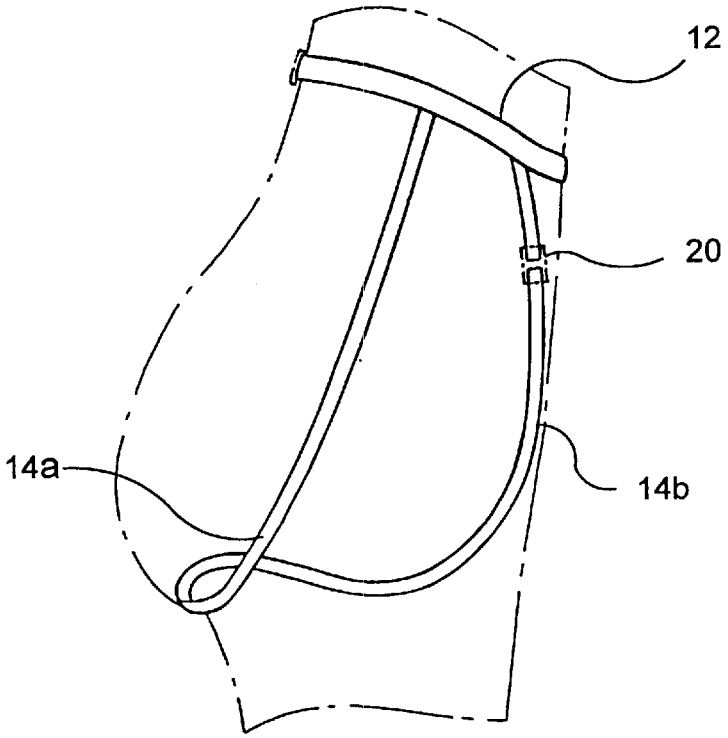

Now turning to FIG. 2 we can examine other aspects of this unique invention. FIG. 2 is a front view of the preferred buttocks support 10 of the present invention as depicted in FIG. 1. As can be seen, the abdominal element 12 encircles the abdomen to provide support for the thigh support elements 14 and 16. As should be appreciated, the thigh support element 14 is comprised of a buttock section 14*a* as depicted in FIG. 1 and an abdominal section 14*b* as depicted herein FIG. 1. Similarly the thigh support element 16 comprises a buttock section 16*a* as depicted in FIG. 1 as well as an abdominal section 16*b* depicted herein in FIG. 2. Essentially, then, each thigh support element 14 and 16 is a band which commences at points Xa and Ya, respectively, then passes across the abdominal area and through the crotch and under the buttocks and terminates at points Xb and Yb, respectively passing under the crotch and around the buttocks in the rear and across the abdominal area in the front. Furthermore, in this embodiment, each abdominal section further includes any type of adjustment means 20 and 22, for adjusting the length of the abdominal section. It should be understood that as the abdominal section is tightened, via the adjustment means 20 for example, the buttock section 14*a* will be tightened therefore reducing the size of the thigh support elements, thus drawing the buttocks upward toward the abdominal loop.

For sizing purposes, the anchor points X and Y need to be on the same places on the body for everyone, the actual location on the abdominal element or loop where the thigh support elements meet will vary based upon the size of the particular wearer.

Figure 3B:
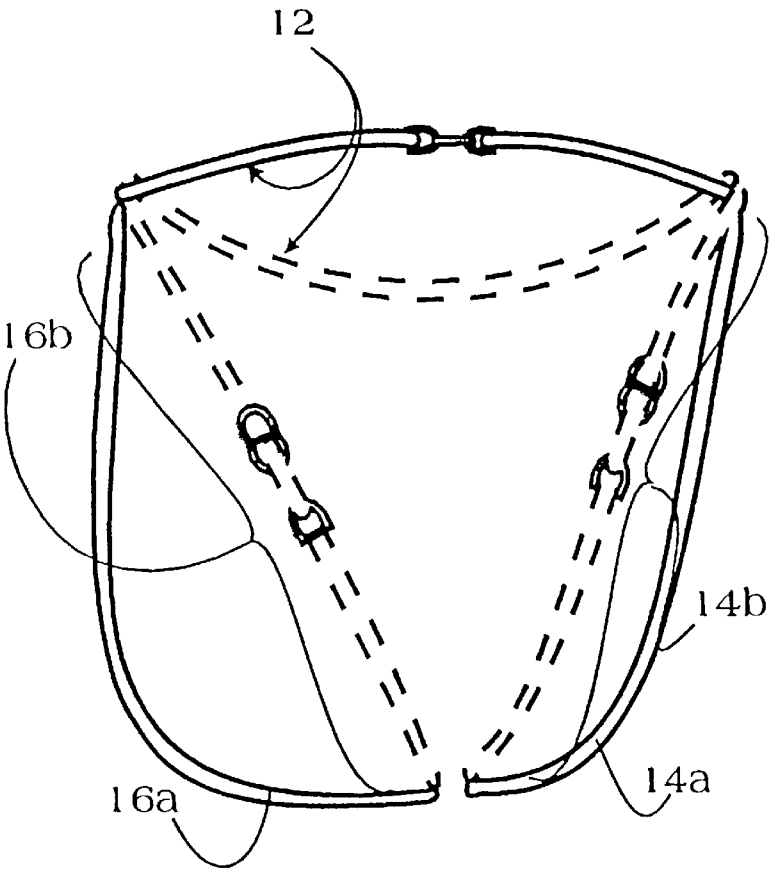
FIGS. 3A and 3B are front and back views, respectively, of the buttocks support of FIGS. 1 and 2.
Figure 3A:
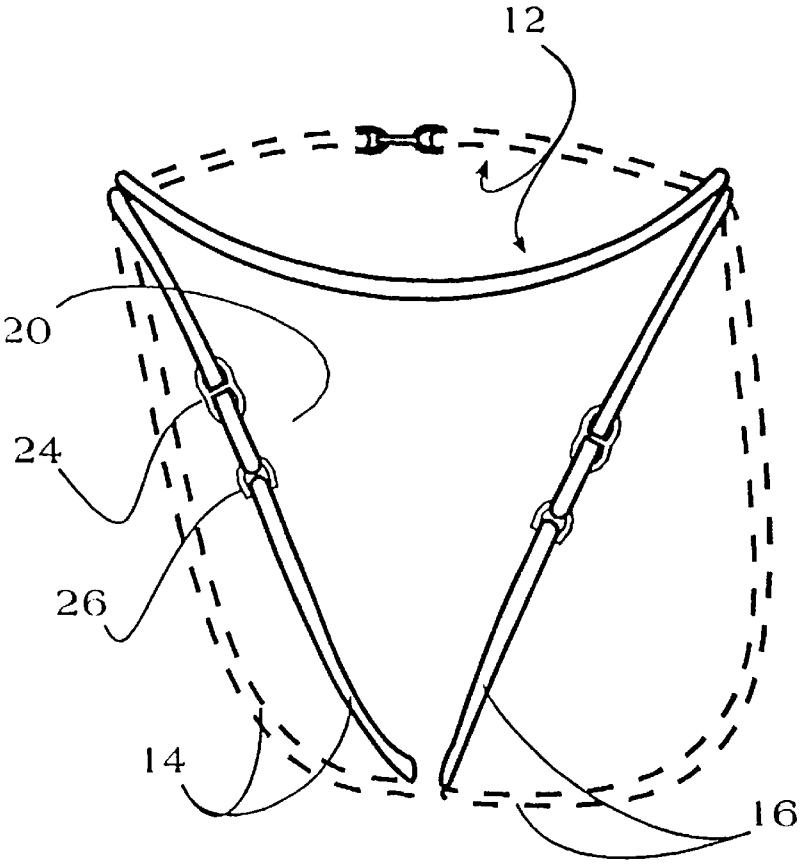

Now turning to FIGS. 3A and 3B we will discuss specific aspects of this present invention. FIG. 3A is a front view of the preferred buttocks support 10 depicted in FIGS. 1 and 2. In this embodiment the abdominal element 12 and thigh support elements 14 and 16 are made from a flexible, however non-stretchable material such as nylon cording, nylon straps, or even some fashion of comfortable rope, etc. Essentially each thigh support element 14 and 16 attaches to the abdominal element 12 by velcro snaps or by any other means. The attachment means 18 can be any sort of common in the art such as a hook and loop, a snap, a button, or even a tied know. Also, the adjustment means, for example element 20, could be any form of adjustment means including but not limited to a conventional slide and loop arrangement. In this example, movement of the slide 24 closer to the loop 26 will lengthen the thigh support element 14 and therefore loosen the fit on the wearer. Conversely, moving the slide 24 away from the loop 26 will result in tightening the thigh support element 14, therefore creating a tighter fit for the user. FIG. 3B is simply a back view depicting the curvature of the buttock sections 14*b* and 16*a*, as they encircle around each buttock.

Figure 4B:
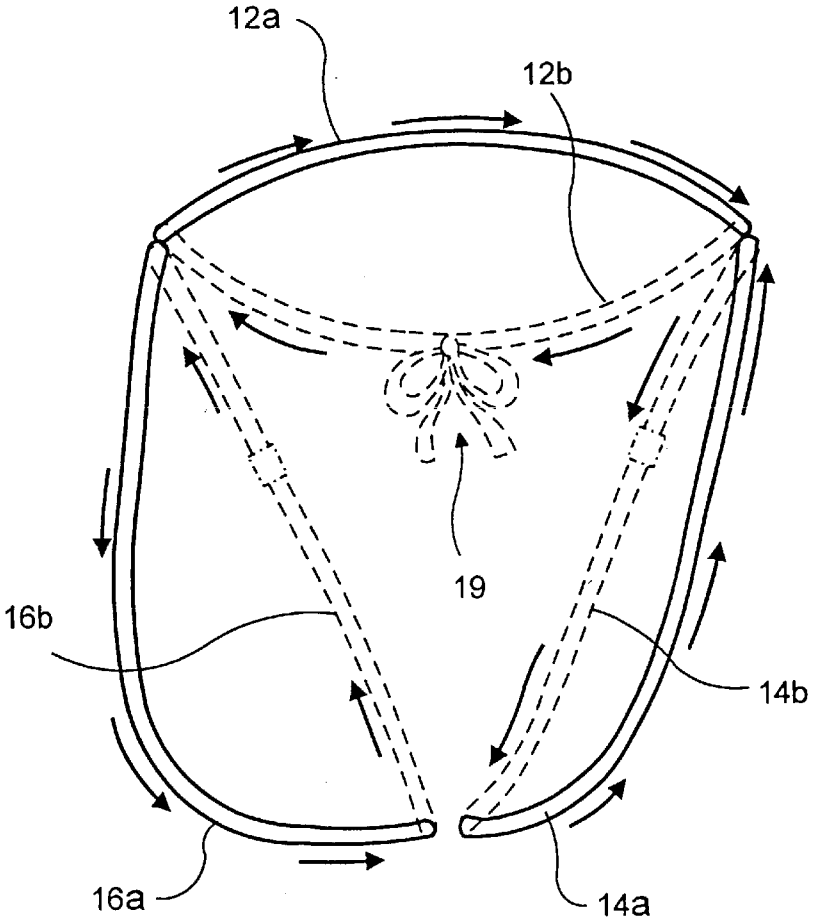
FIGS. 4A and 4B are front and back views, respectively, of another preferred buttocks support of the present invention having a unitary support member.
Figure 4A:
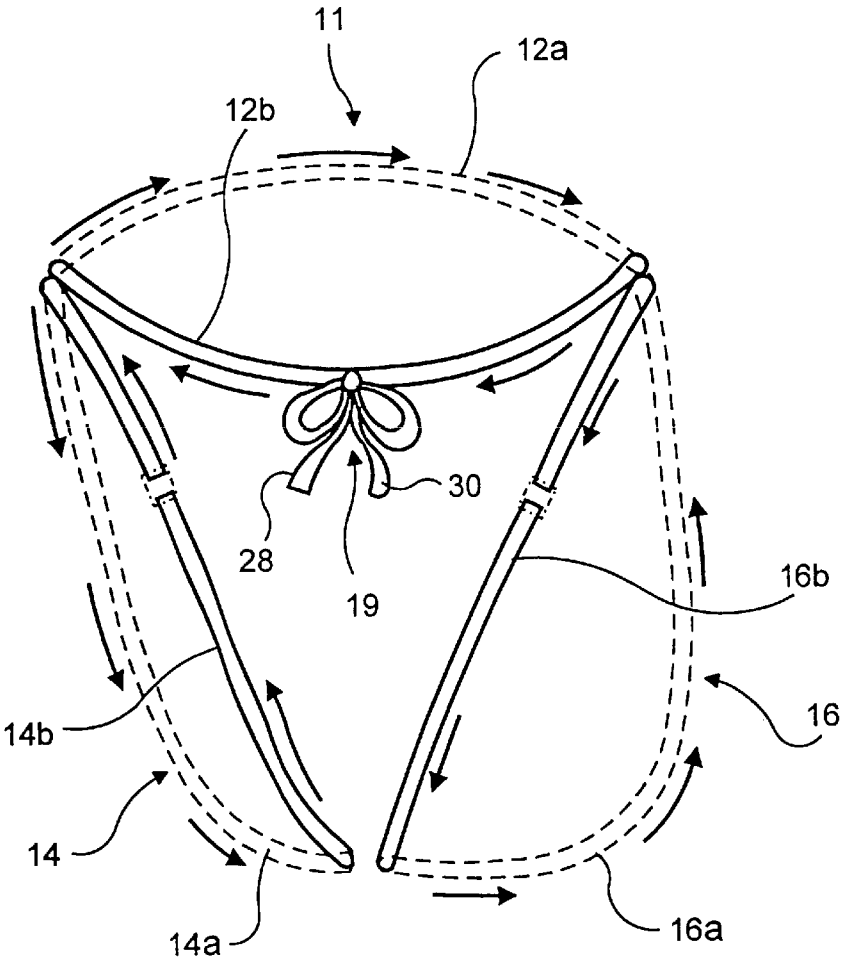

Now turning to FIGS. 4A and 4B we can discuss yet another preferred embodiment of the present invention showing a device made from the unitary support member. FIGS. 4A and 4B are front and back views, respectively, of another preferred buttocks support of the present invention having a unitary support member. In this case, the entire buttocks support, 11, is made from a single piece of cording, strapping or any other material as described above in connection with FIGS. 1 through 3. By way of example we will discuss one possible arrangement of this unique buttock support, 11. In this case, the unitary support member starts at about the center, where bow 19 is, of element 12*b* and passes approximately one quarter of the way around the waist. It then goes down the backside in the direction of arrows along element 14*a* and under the buttock and goes through underneath the crotch area, then back up the lower abdomen of the same side (following arrows along element 14*a*) and back in the direction of arrows along element 12*a*. It then proceeds and progresses across the back half of the abdominal element and down the other side of the lower abdomen in the direction of the arrows along element 16*b*, goes through under the crotch area, under the other buttock and up the back in the direction of arrows along element 16*a*. It then proceeds through the other front quarter to the starting point 19, by way of arrows in the direction of element 12*b*. The cord or unitary support member must have an open pathway at all points across and around the entire garment. At this point the first end 28 and the second end 30 will be attached to one another via an attachment means 19 (shown here as a simple knot). It should be understood that this is one example of a sequence for wrapping the cord around one's self; certain persons may prefer another route—there should be no distinction between the route shown and some other route, as long as the abdominal element 12 and thigh support element 14 and 16 are formed in the process. While in some respects the embodiment of FIGS. 4A and 4B might be more complicated then those previously discussed in connection with FIGS. 1 through 3 it is also simpler. It can be donned and adjusted by tightening or loosening this single cord and the proper fit is desired. Furthermore, this device will transfer and or self-adjust between each thigh support elements and the abdominal element while being worn, possibly making it more comfortable for the user.

Figure 5B:
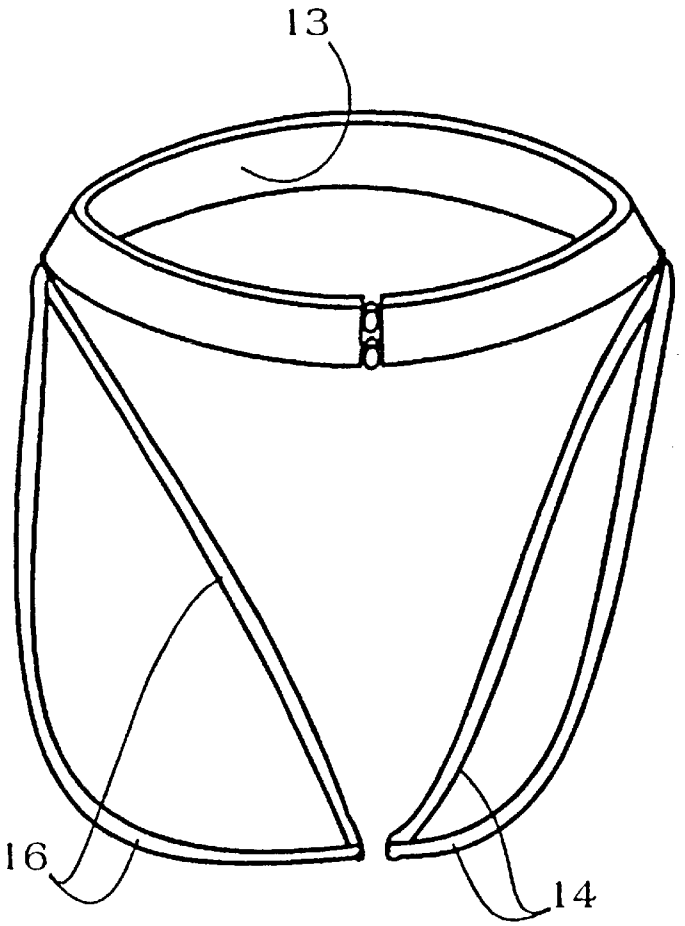
FIGS. 5A and 5B are front and back views, respectively, of another preferred buttocks support of the present invention having a panel-type abdominal element.
Figure 5A:
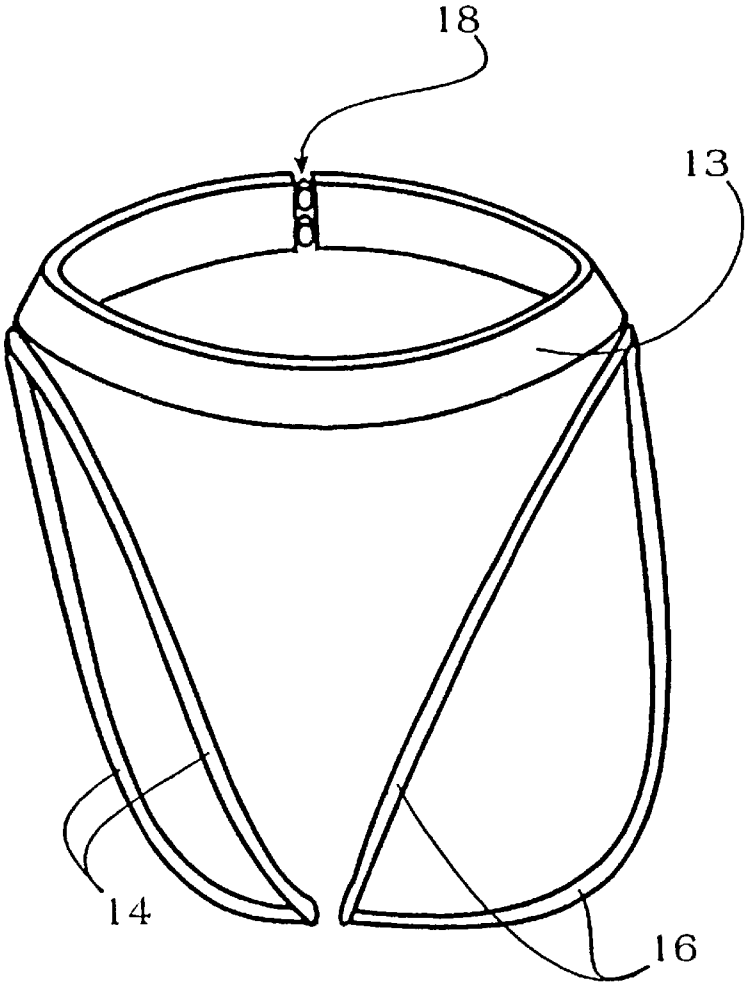

Now turning to FIGS. 5A and 5B we can review yet another embodiment of the present invention. FIG. 5A is a front view of still another preferred embodiment of the present invention. In this case an alternative version of the abdominal element 13 is employed. Abdominal element 13 is potentially substantially wider than those previously discussed. This embodiment differs from the embodiments shown in FIGS. 1–3 in that the lower abdominal sections of the abdominal elements 14*b* and 16*b* are attached to the decorative extension of the abdominal element when there is such a decorative section. It will provide a decorative garment that in fact may be constructed from lace or other material or have lace or other material attached to it.

Furthermore, the attachment means 18 used here would be very similar to those used for the embodiments of FIGS. 1–3.

There may be an unlimited number of attachment means, including but not limited to, one or several hooks, loops or a zipper. Also, it should be appreciated that the alternative abdominal element 13 may also be constructed from leather, elastic or any other selected material.

Figure 6:
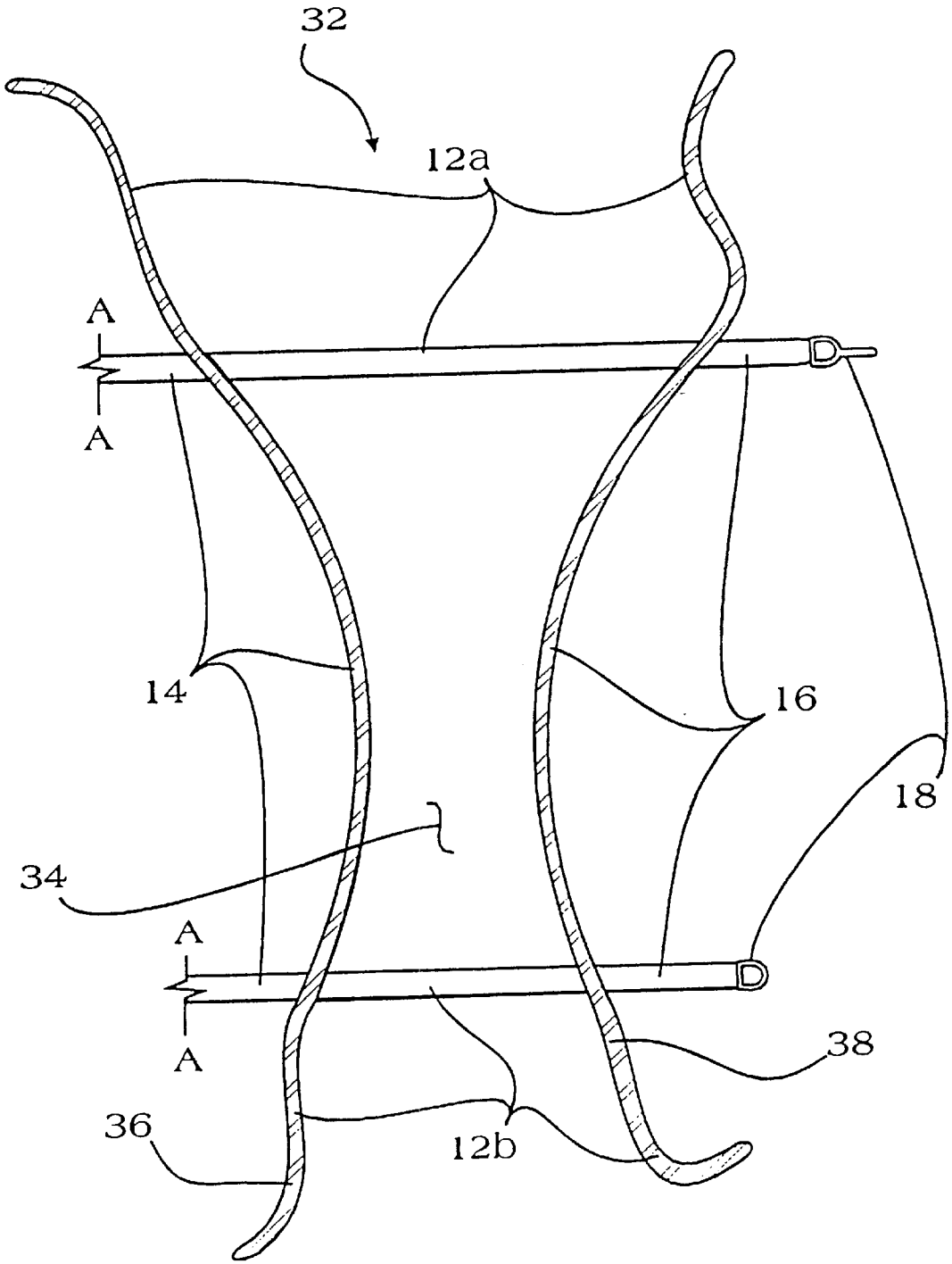
FIG. 6 is a front view of a sleeved-fully covered buttocks support of the present invention.
Figure 7B:
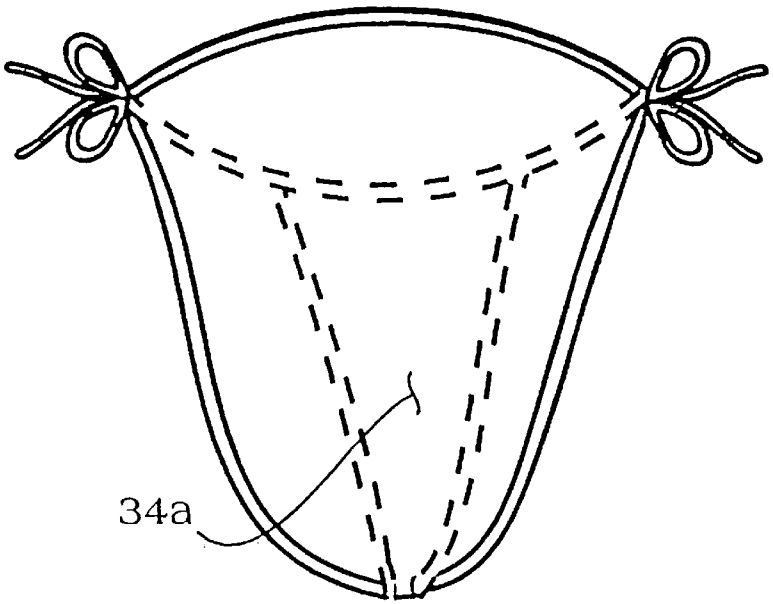
FIG. 7 is a top view of yet another preferred buttocks support of the present invention.
Figure 7A:
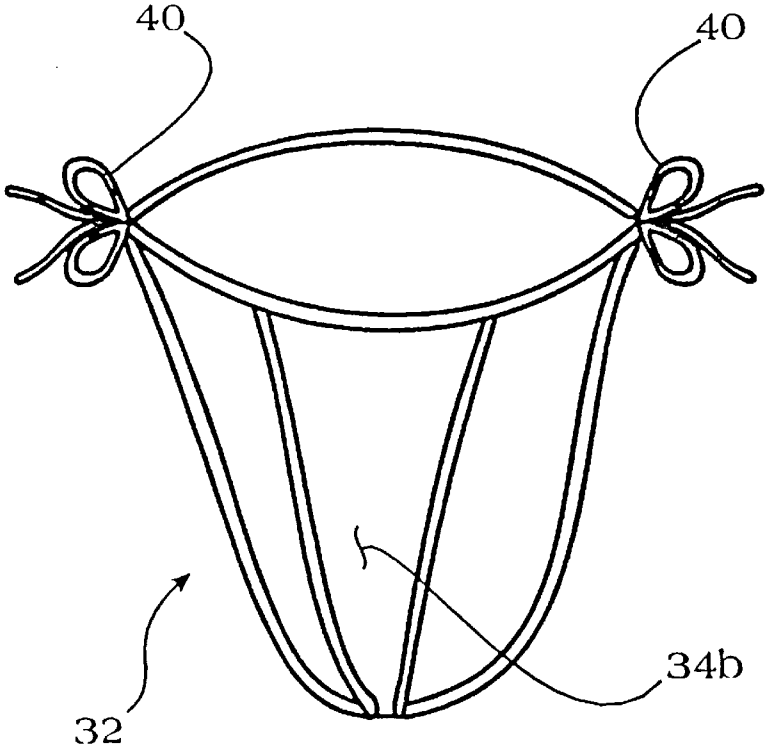

Now turning to FIGS. 6, 7A and 7B we can discuss yet another preferred embodiment of the present invention. FIG. 6 is a top view of yet another preferred buttocks support of the present invention; and FIGS. 7A and 7B are front and back views, respectively, of the buttocks support of FIG. 6. As can be seen, this buttock support 32 comprises a center panel 34 such as from lace or other material, and a pair of cords 36 and 38 running along the edges thereof. The unique aspect of this invention is that the cords 36 and 38 are attached to the center panel 34 in a sliding fashion, such as through an open hem in the opposing edges of the center panel 34. The thigh support elements 14 and 16 are made up from the section of the cords 36 and 38 passing through the edges of the center panel 34. The end portions of the cords 36 and 38 go on to form the front and rear sections of the abdominal ring 12*b* and 12*a*, respectively. FIGS. 7A and 7B depict how this bikini type buttock support 32 is worn. In this case the two cords 36 and 38 are tied at each hip to form the alternative attachment means 40. Other means for attaching the cords 36 and 38 to themselves might be used such a snaps, loops or other methods. As can be seen once the buttock support 32 is put on there will be a center panel 34, having a front section 34*b* and a rear section 34*a*, thereby providing cover for the wearer in addition to the lift and support provided by the thigh support elements 14 and 16.

The cords 36, 38 in FIG. 6 can be arranged to tie at the waist or hip level or at the sides of the hips or waists as shown in FIGS. 7A and B, or else be arranged on the support device 10 to tie at the top of the thighs of the legs and the bows of the tied cords can be tucked in under the garment.

Figure 8A:
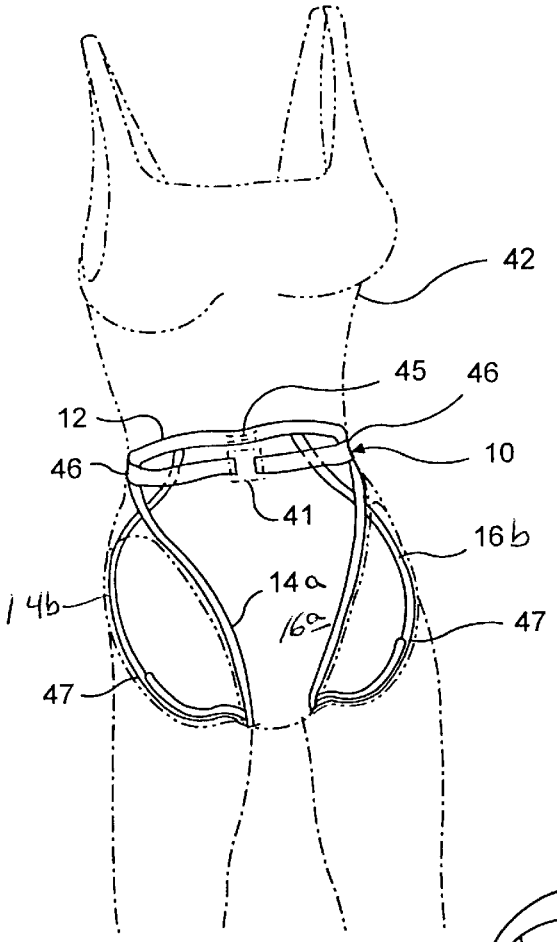
FIGS. 8A and 8B are front and back views, respectively, of the buttocks support of FIG. 7.
Figure 8B:
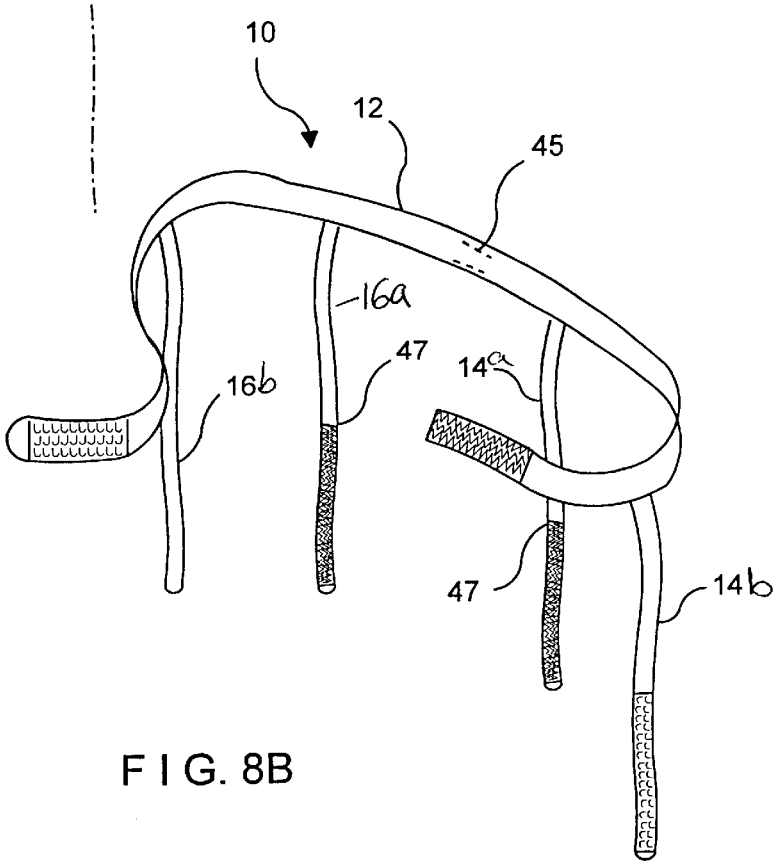

FIGS. 8A and 8B show another embodiment of the buttocks support 10 in which the buttock support can be inserted in to various articles of clothing such as pantyhose, swimsuits, as shown in FIGS. 8A and 8B and short exercise clothing. Portions of the abdominal support element 12 and the thigh support elements 14*a* and 14*b* and 16*a* and 16*b* are sewn into the clothing and other portions of support elements 12, 14*a*, 4*b* and 16*a*, 16*b* are not in order to provide enough slack in these elements 12, 14 and 16 for a user's comfort and adjustability of the support elements 12, 14 and 16 for size adjustment, comfort and accessibility to the support elements 12, 14 and 16. The buttock support 10 is located inside the swimsuit 42. The device 10 includes the closure or attachment device 41. The abdominal element 12 is attached to the swimsuit 42 by attachment such as by being sewn to the swimsuit 42 at point 45 (shown in dashed lines) and at point 46 near the hips. The lower portions of the thigh support elements 14 and 16 are sewn in to the swim suit 42 and covered with Velcro brand material or some other attachment from points 47 on the elements 14 and 16 downward and preferably along the crotch area where the back straps or back portions of elements 14 and 16 have coordinated attachment means and meet with these bottom front portions of the elements 14 and 16 to hold onto the article of clothing and keep it in place. Once fitted to the wearer's size the attachments need not be undone , e.g. Velcro brand support elements do not have to be unattached as the wearer can simply slip the article of clothing on or off.

Those skilled in the art will appreciate that various adoptions and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A buttocks support device for supporting and lifting a user's buttocks, comprising:

an abdominal element adapted to encircle a user's midriff;

a pair of thigh support elements each adapted to be connected to a portion of said abdominal element, each said thigh support element being connected to a front portion of said abdominal element near a user's front midriff area and adjacent a user's pelvic area, a remaining portion of each said thigh support element being placed past a respective one of a user's inner thigh area and under a user's groin area and being adapted to framingly encircle a bottom surface of a respective buttock of a user and being adapted to attach at a portion of said abdominal element so that each said thigh support element supports and lifts a user's buttock.

2. The buttocks support device according to claim 1 wherein said pair of thigh support elements are formed of an elastic strap-like material.

3. The buttocks support device according to claim 1 wherein said pair of thigh support elements are formed of a rigid strap-like material.

4. The buttocks support device according to claim 1 wherein said pair of thigh support elements each contain an adjusting means to adjust each said thigh support element to a user's size.

5. The buttocks support device according to claim 1 wherein said device is custom fitted to a user's size.

6. The buttocks support device according to claim 1 wherein said abdominal element is formed of an elastic strap-like material.

7. The buttocks support device according to claim 1 wherein said abdominal element is formed of a rigid strap-like material.

8. The buttocks support device according to claim 1 wherein said abdominal element contains an adjusting means to adjust said abdominal element to a user's size.

9. The buttocks support device of claim 4 wherein each said adjusting means includes a slide and a loop, and said adjusting means include sliding said slide either towards or away from said loop.

10. The abdominal element of claim 1 wherein each said adjusting means includes a slide and a loop, and said adjusting means include sliding said slide either towards or away from said loop.

11. The buttocks support device of claim 1 wherein said abdominal element and said pair of thigh support elements are covered with material to prevent chafing and irritation of a user's skin.

12. The buttocks support device according to claim 11 further comprising adjusting means for said thigh support elements and said abdominal element and wherein said material covering has openings therein to permit access to each of said adjusting means.

13. The buttocks support of claim 1, wherein said abdominal element comprises an elongate member having opposing ends, said abdominal element further comprising attachment means for attaching and detaching one of said ends to and from another said ends.

14. The buttocks support of claim 13 wherein said attachment means comprises a hook attached to said one of said ends and a loop attached to said another of said ends, said hook and loop cooperating to provide said attaching and detaching.

15. The buttocks support of claim 14 wherein said abdominal loop comprises a flat, pliable material.

16. The buttocks support of claim 1 further comprising a center panel extending between each said thigh support element.

17. The buttocks support device according to claim 1 wherein said pair of thigh support elements are formed of two pieces of material.

18. The buttocks support device according to claim 1 wherein said pair of thigh support elements is formed of one piece of material.

19. The buttocks support device according to claim 1 wherein said device is partially sewn into an article of clothing.

20. The buttocks support device according to claim 1 wherein said abdominal element has material attached at its rear and front portions to form an article of clothing.

21. The buttocks support device according to claim 1 wherein said article of clothing is a thong bikini bottom.

22. A method for supporting and lifting a user's buttocks, the steps comprising:

encircling a user's midriff with an abdominal element; and supporting a user's buttocks with a pair of thigh support element each formed of a supporting member each adapted to be connected to a portion of said abdominal element, each said supporting member being connected to a front portion of said abdominal element near a user's front midriff area and adjacent a user's pelvic area, a remaining portion of each of said thigh support element being placed past a respective one of a user's inner thigh area and under a user's groin area and being adapted to frame and encircle a bottom surface of a respective buttock of a user and being adapted to attach at a portion of said abdominal element so that each said thigh support element supports and lifts a user's buttock.

* * * * *